United States Patent [19]

Shilling

[11] Patent Number: 5,048,613

[45] Date of Patent: Sep. 17, 1991

[54] WIRELINE RESETTABLE PACKOFF ASSEMBLY

[76] Inventor: James R. Shilling, Rte. 2, Box 34, Pampa, Tex. 79065

[21] Appl. No.: 200,243

[22] Filed: May 31, 1988

[51] Int. Cl.[5] ..... E21B 33/127

[52] U.S. Cl. ..... 166/387; 166/123; 166/182

[58] Field of Search ..... 166/123, 124, 126, 131, 166/134, 138, 143, 148, 151, 181, 182, 184, 386, 387

[56] References Cited

U.S. PATENT DOCUMENTS

| | | | |
|---|---|---|---|
| 3,509,940 | 5/1970 | Young | 166/121 |
| 4,432,418 | 2/1984 | Mayland | 166/184 X |
| 4,436,150 | 3/1984 | Barker | 166/131 |
| 4,437,516 | 3/1984 | Cockrell | 166/182 X |
| 4,460,041 | 7/1984 | Berryman | 166/134 |
| 4,518,037 | 5/1985 | Youngblood et al. | 166/138 X |
| 4,545,431 | 10/1985 | Fore | 166/183 |
| 4,593,765 | 6/1986 | Greenlee | 166/387 |
| 4,648,445 | 3/1987 | Caskey | 166/181 X |
| 4,648,446 | 3/1987 | Fore et al. | 166/123 |
| 4,693,309 | 9/1987 | Caskey | 166/123 |
| 4,708,208 | 11/1987 | Halbardier | 166/182 X |

*Primary Examiner*—William P. Neuder

[57] ABSTRACT

A well packoff assembly can be set on wireline and reset at a new location on tubing. The packoff assembly has a check valve that actuates when a retrieving tool is lowered into contact with the packoff assembly. The check valve allows fluid below the packoff assembly to flow up if the pressure is greater, but prevents any downward flow. A second port opens to allow downward flow as the retrieving tool releases the slips and seal assembly of the packoff assembly. The packoff assembly is set by a wireline tool which uses a three piece mandrel. The lower piece shears from the intermediate piece once the packer is fully set. The upper piece then separates from the intermediate piece. The intermediate piece stays with the packoff assembly and is sealed in the axial passage to allow the packoff assembly to serve as a bridge plug. The body of the packoff assembly has a set of lower threads engaged by a lower ratchet nut to hold the body in an upper released position after it has been released by the retrievable tool.

23 Claims, 9 Drawing Sheets

WIRELINE RESETTABLE PACKOFF ASSEMBLY

BACKGROUND OF THE INVENTION

1. Field of the Invention

This invention relates in general to packoff assemblies for sealing in casing in a well, and in particular to a packoff assembly that is set on wireline.

2. Description of the Prior Art

There are occasions when testing and treating wells, that a packoff assembly, particularly a bridge plug, must be set at different levels. For example, a bridge plug may be set above a lower zone previously tested to isolate the lower zone from a zone above to be tested. If there are a number of zones to be tested in the well, the bridge plug may be reset at various levels.

One method for setting bridge plugs is to lower them on tubing. The bridge plug will be set by manipulating the tubing, typically rotating it. While this is satisfactory, setting the bridge plug initially on tubing is not very accurate. In a deep well, the depth of the bridge plug may be off a considerable amount.

Bridge plugs are also set on wireline. The bridge plug is connected to a wireline tool, lowered to the desired depth, then set. Normally, the bridge plug is set in this manner by sending an electrical charge from the surface to ignite an explosive to cause the setting. The bridge plug can be set at a very accurate depth because the wireline operator can tie in the depth to previous logs of the formation made before running casing.

Some wireline set bridge plugs can be retrieved. They are retrieved by lowering tubing onto the bridge plug and rotating or picking up the tubing to release the bridge plug. These bridge plugs cannot be reset to a different depth. Either a new bridge plug must be lowered from the surface on tubing, or on wireline again.

U.S. Pat. No. 4,593,765 discloses a resettable bridge plug. That bridge plug is initially ran on wireline. It can be released and reset on tubing without pulling the bridge plug to the surface. While the tool shown in U.S. Pat. No. 4,593,765 appears feasible, improvements are desirable.

One danger that is present with a retrievable bridge plug is the possibility of considerably higher pressure below the bridge plug than above. The pressure across the seal elements should equalize before the slips and seal elements are released from the set position. Retrievable bridge plugs do have bypass passages that allow the pressure to equalize. However, these bypass passages normally open simultaneously with the release of tension on the slips. There is a possibility of the bridge plug being blown up the well before the pressure fully equalizes. This could corkscrew the tubing and cause considerable damage.

SUMMARY OF THE INVENTION

In this invention, a wireline setting tool is used to set the packoff assembly. A retrieving tool is adapted to be connected to a string of tubing for retrieving the packoff assembly and resetting it. A check valve is located in the packoff assembly above the seal elements. When the retrieving tool engages the packoff assembly, the check valve is actuated. It will allow well fluid to flow up through the packoff assembly if the pressure is greater from below than above. This allows pressure equalization without any releasing movement on the slips and seal. The check valve will not allow any downward flow, which could otherwise interfere with the releasing mechanisms.

After the retrieving tool operates the check valve, a second bypass passage is opened as the slips and seal assembly is released. The second bypass passage allows downward flow of well fluid through the packoff assembly.

The preferred packoff assembly has a body and a carriage mounted to the body which carries the slips and seal elements. The body has spaced apart threaded sections, the upper section being left-hand threads and the lower section being right-hand threads. Ratchet nuts for each threaded section are carried by the carriage. The ratchet nuts are spaced apart so that only one can engage a threaded section at one time. The upper threaded section holds the slips and seal in the set position when engaged by the upper ratchet nut. The lower ratchet nut when engaging the lower threaded section holds the body in an upper position while the packoff assembly is being moved to a new location for resetting.

Drag blocks are also mounted to the carriage. The drag blocks when lowered in by the wireline tool are in a collapsed position. An energizing mechanism shears a pin to release the drag blocks when the wireline tool first sets the packer.

The wireline setting tool has a three piece mandrel that is used to set the packer. The upper and intermediate mandrel sections are connected together by releasable fingers. The lower and intermediate sections are connected by a frangible stud. When the wireline tool pulls upward on the mandrel, the slips and seal will actuate to set the packer. The stud parts when the packer is set.

After the packer is set, the fingers release the upper mandrel section from the intermediate mandrel section to allow the upper portion of the mandrel to be retrieved to the surface. The passage through the packoff is sealed by an O-ring seal which engages the intermediate section of the mandrel.

DESCRIPTION OF THE PREFERRED EMBODIMENT

Figure 1A:
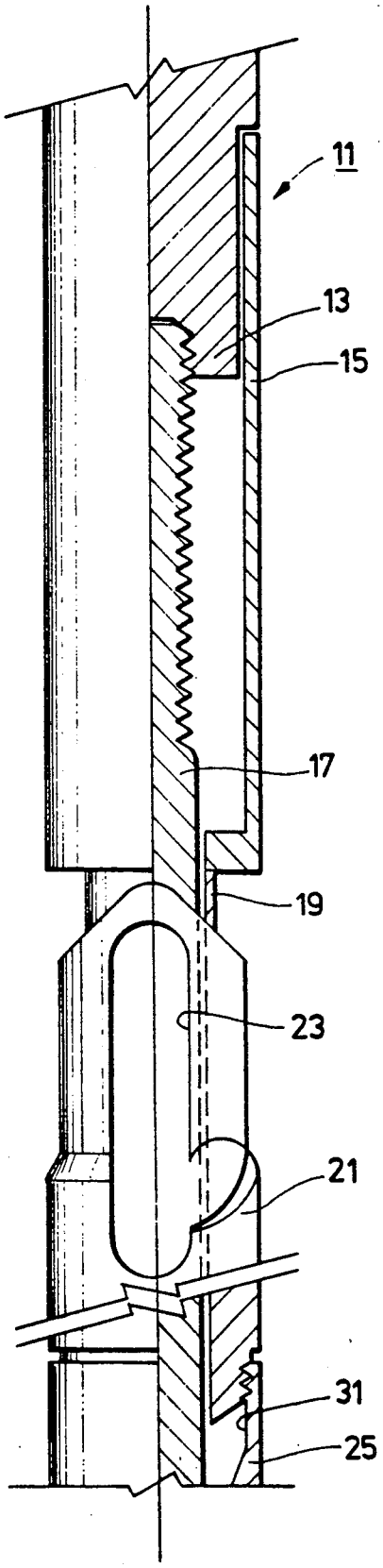
FIGS. 1A–1D are vertical sectional views of a packoff assembly connected to a wireline setting tool, shown in the running in position, and constructed in accordance with this invention.

Referring to FIG. 1A, a wireline setting tool 11 is schematically shown. The wireline setting tool 11 has a body 13 and a setting sleeve 15. The body 13 is part of an actuating means that will cause the setting sleeve 15 to move downward relative to the body 13 when actuated. The wireline setting tool 11 is conventional in this respect. Typically, the actuating means will include a chamber (not shown) which communicates with an explosive charge. Electrical power provided down a wireline cable ignites an igniter which ignites the charge to create a gas under high pressure. The high pressure causes the relative movement between the body 13 and the setting sleeve 15.

An upper mandrel section 17 is screwed to the body 13 for movement therewith. The upper mandrel section 17 is a solid rod that extends downward from the body 13. The setting sleeve 15 bears against a tubular neck 19 that protrudes upward from an adapter 21. The upper mandrel section 17 extends through the axial passage in the adapter 21.

Adapter 21 has a J-slot 23. Slot 23 has a vertical portion and a helical portion for guiding a pin of a retrieving tool 24, shown in FIGS. 3 and 4A, which will be described subsequently.

Figure 1B:
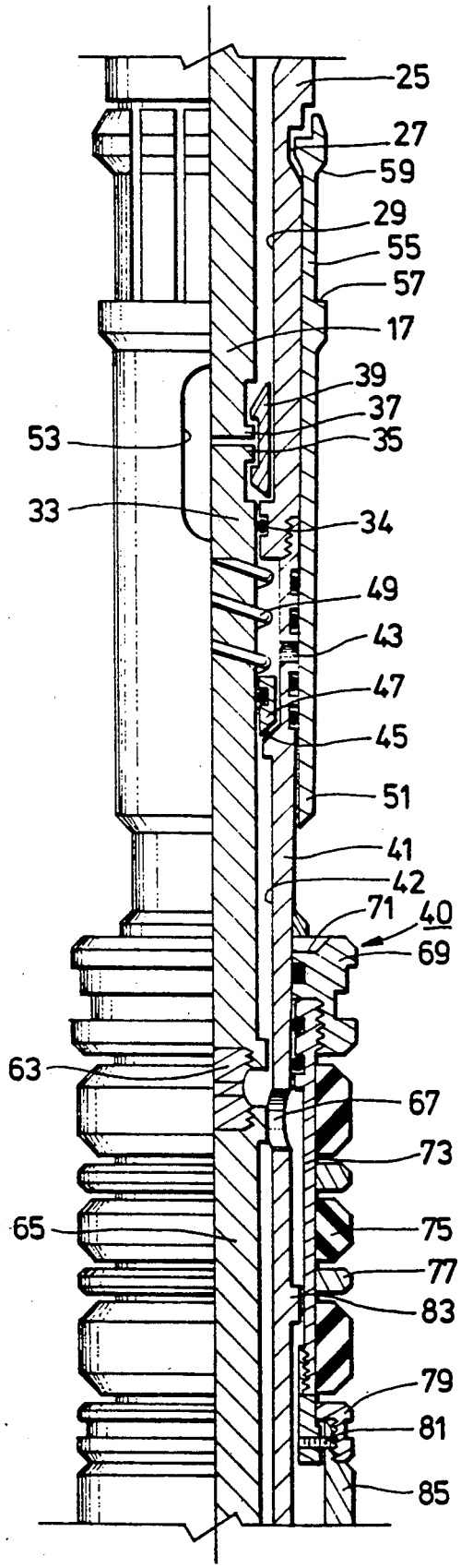

The adapter 21 is screwed to the upper end of a collet body 25. Referring to FIG. 1B, body 25 is a tubular member having an exterior locking groove 27. Collet body 25 has an axial passage 29 that extends through it. The upper mandrel section 17 extends into this axial passage 29. A recess 31 provides an enlarged diameter section in the axial passage 29 and is located at the upper end of the collet body 25.

Referring still to FIG. 1B, an intermediate mandrel section 33 is releasably connected to the upper mandrel section 17. The intermediate mandrel section 33 extends downward from the upper mandrel section 17. The intermediate mandrel section 33 joins the upper mandrel section 17 in the collet body axial passage 29. An O-ring seal 34 seals the intermediate section 33 within the axial passage 29 to prevent the upward flow of any well fluid through axial passage 29.

The intermediate mandrel section 33 has a recess on its upper end which defines a flange or shoulder 35. The upper mandrel section 17 has a recess on its lower end which defines a flange or shoulder 37. The shoulders 35, 37 abut each other in the running in position shown in FIG. 1B.

Figure 2A:
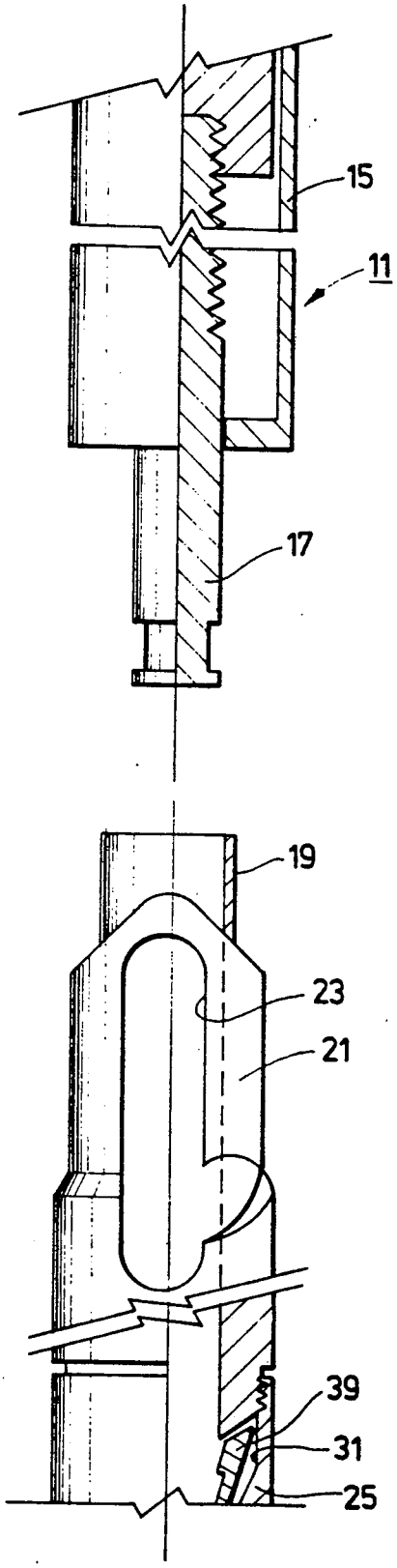
FIGS. 2A–2D are vertical sectional views of the packoff assembly of FIG. 1, and showing the packoff assembly in the set position.

A plurality of fingers 39 with hooks on their ends extend into the grooves to releasably retain the shoulders 35, 37 together. Fingers 39 are biased outward. The axial passage 29, however, prevents the fingers 39 from releasing the shoulders 35, 37 until the fingers 39 reach the recess 31 (FIG. 1A). In the recess 31, as shown in FIG. 2A, the upper portions of the fingers 39 will spring outward, releasing engagement with the shoulder 37 to allow the upper mandrel section 17 to be retrieved.

A packoff assembly 40 is located below the collet body 25. The packoff assembly 40 has a tubular body 41 that extends through it. Body 41 protrudes upward and is connected by threads to the lower end of the collet body 25. Body 41 has an axial passage 42 that is coaxial with the collet body axial passage 29.

An upper port 43 extends through the wall of the body 41. A seat 45 is located in the axial passage 42 below the upper port 43. A valve member 47 is carried on the seat 45. Valve member 47 sealingly receives the intermediate mandrel section 33 and will seal on the seat 45. A spring 49 urges the valve member 47 down to the lower closed position. When moved to the upper position shown in FIG. 3 by sufficiently higher pressure on its lower side, the valve member 47 will compress the spring 49 and move above upper port 43 to allow the flow of well fluid up the axial passage 42 and out the upper port 43. The valve member 47 is located below the O-ring seal 34.

The upper port 43 is opened and closed by a valve sleeve 51. Valve sleeve 51 will move between a closed position shown in FIG. 1B to an open position shown in FIG. 3. Valve sleeve 51 is sealingly carried on the exterior of the body 41 and also the collet body 25. Valve sleeve 51 has a plurality of holes 53 that locate above the upper port 43 while the valve sleeve 51 is in the upper closed position. In the lower open position, shown in FIG. 3, holes 53 will register with the upper port 43 to allow fluid flow past the valve member 47 and out the upper port 43. Holes 53 are elongated in the vertical direction.

The valve sleeve 51 has a plurality of collet fingers 55 on its upper end. Collet fingers 55 serve to retain the valve sleeve 51 in the upper position. The collet fingers 55 are inwardly biased. They snap into the collet body groove 27 while in the upper position. Valve sleeve 51 has an upward facing shoulder 57 that is located at the base of the collet fingers 55. The shoulder 57 is engaged by the retrieving tool 24 (FIG. 3) to push the valve sleeve 51 down to the open position. Each collet finger 55 has a downward facing shoulder 59. The shoulders 59 are engaged also by the retrieving tool 24 to pull the valve sleeve 51 back to the closed position.

Referring still to FIG. 1B, a shear stud 63 connects the intermediate mandrel section 33 with a lower mandrel section 65. The lower mandrel section 65 extends downward through the axial passage 42. Shear stud 63 is a frangible member adapted to part at a selected tensile force. This tensile force occurs when the packoff assembly 40 is set.

A lower port 67 is located in the sidewall of the packoff body 41 a selected distance below the upper port 43. The lower port 67 is preferably circular and considerably larger in diameter than the upper port 43. The lower port 67 moves from a closed position, as shown in FIG. 1B, to an open position shown in FIG. 4B. In the open position, the port 67 will be located above a closure means which includes a top seal ring 69. The top seal ring 69 sealingly engages the outer wall of the body 41.

The top seal ring 69 has a concave, annular recess 71 formed on its upper end. Recess 71 serves to collect debris in the well that may occur as a result of testing and treating. Top seal ring 69 is secured to a seal sleeve 73.

Seal sleeve 73 also sealingly engages the body 41, assisting in closing the lower port 67. The body 41 will rotate and axially move relative to the top seal ring 69 and seal sleeve 73. The seal sleeve 73 holds three elastomeric seal elements 75. The seals 75 are annular members which will seal against the well casing (not shown) when deformed to the position shown in FIG. 2B. The seals 75 are separated by metal spacers 77. A gage ring 79 is located below the lowermost seal 75.

The gage ring 79 will move upward relative to the top seal ring 69 to deform the seals 75. A shear pin 81 will shear to allow the gage ring 79 to move upward. The seal sleeve 73 and the top seal ring 69 remain stationary relative to body 41 while the gage ring 79 moves upward. An external shoulder 83 on body 41 engages the seal sleeve 73 to keep the seal sleeve stationary during the setting movement.

Figure 1C:
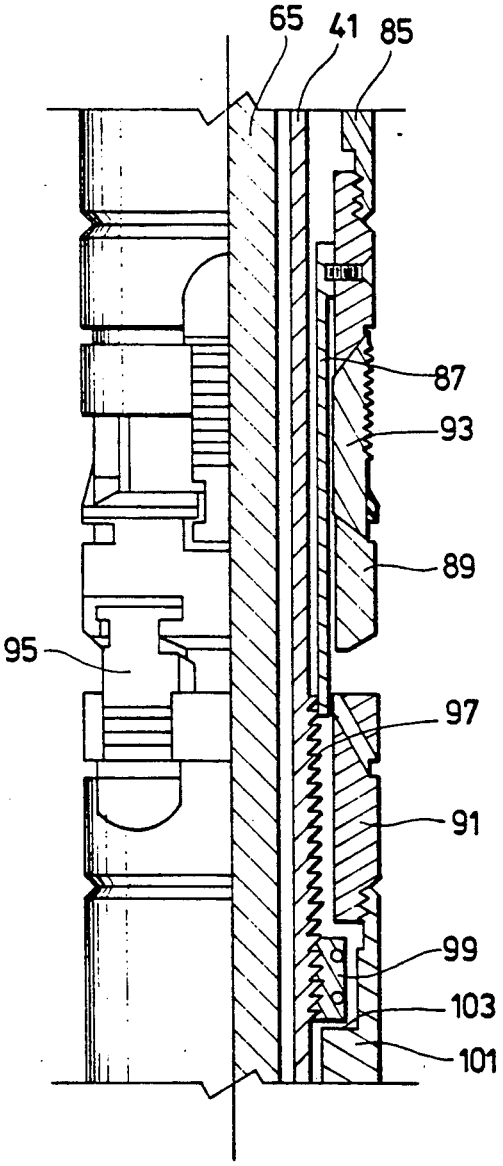

The shear pin 81 connects the gage ring 79 to an upper slip bowl 85, as shown in FIG. 1C. The upper slip bowl 85 is conventional. A slip tie sleeve 87 is secured to the upper slip bowl 85 and extends downward. A slip retainer ring 89 is located below the upper slip bowl 85. A lower slip bowl 91 is located below the slip retainer ring 89. A plurality of upper slips 93 are carried by the upper slip bowl 85. A plurality of lower slips 95 are carried by the lower slip bowl 91. The slips 93, 95 have gripping teeth on the exterior to grip the casing (not shown). The slips 93, 95 are carried on inclined sections of the slip bowls 85, 91. As a result, when the lower slip bowl 91 moves upward relative to the upper slip bowl 85, the slips 93, 95 will be forced outward. The retracted position is shown in FIG. 1C and the extended or set position is shown in FIG. 2C.

Referring still to FIG. 1C, the packoff body 41 has an upper threaded section 97 which is located inward from the lower slip bowl 91. The upper threaded section 97 has exterior left-hand threads. Each of the threads of the upper threaded section 97 has a sawtooth configuration with an upper flank that is substantially perpendicular to the axis of the body 41 and a downward facing lower flank that is inclined.

An upper ratchet or locknut 99 is adapted to engage the upper threaded section 97. Locknut 99 is maintained non-rotatable relative to the body 41 by means of keys or pins (not shown) engaging a drag block body 101. Locknut 99 consists of a plurality of segments separated from each other and connected by springs. This enables the locknut 99 to expand and ratchet on the upper threaded section 97. That is, when the body 41 moves downward relative to the locknut 99, it will ratchet from the running in position shown in FIG. 1C to the set position shown in FIG. 2C. In the set position shown in FIG. 2C, the locknut 99 bears against the lower slip bowl 91, preventing the lower slip bowl 91 from moving downward relative to the upper slip bowl 85 and to the body 41.

The upper locknut 99 locates in a recess in the drag body 101. Drag block body 101 is rigidly secured to the lower slip bowl 91. Drag block body 101 has an upper shoulder 103 which engages the upper locknut 99.

Figure 1D:
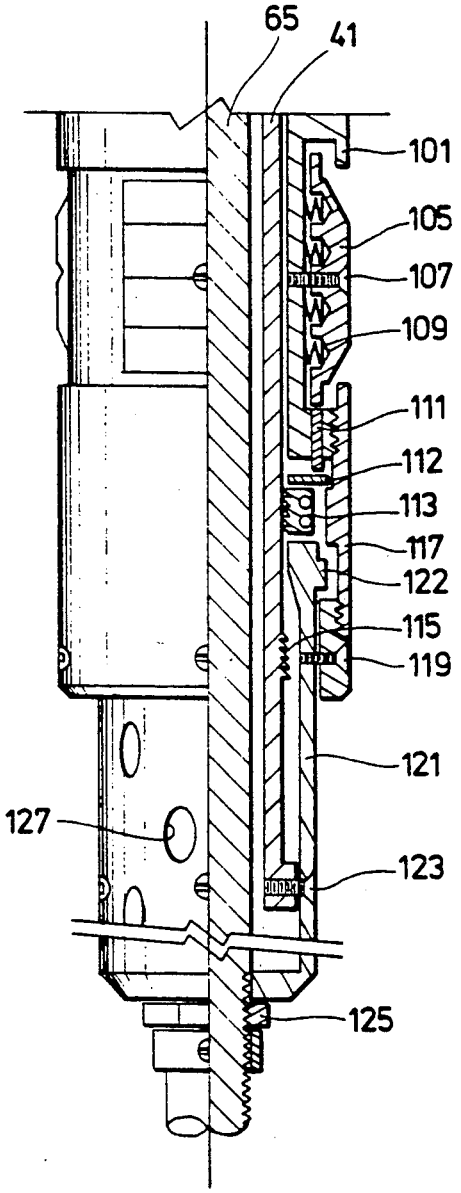

Referring to FIG. 1D, the drag block body 101 holds a set of drag blocks 105. The drag blocks 105 are spaced circumferentially around the drag block body 101. Each drag block 105 comprises a pad that is adapted to frictionally engage the casing of the well when the drag block 105 is in the expanded position. A shear screw 107 holds a plurality of springs 109 in the compressed state shown in FIG. 1D while the wireline setting tool 11 (FIG. 1A) lowers the packoff assembly 40 into the well. When the shear screws 107 are sheared, the springs 109 will force the drag blocks 105 out to frictionally engage the casing as shown in FIG. 2D.

The releasing means to shear the shear pin 107 includes a plurality of push rods 111. Each push rod 111 extends slidingly through a small hole in the drag block body 101. When the push rods 111 are pushed upward with sufficient force, they will push the drag blocks 105 upward, causing a transverse shear of the shear screws 107. The cavity of the drag block body 101 which holds the drag blocks 105 is sufficiently greater in length than the drag blocks 105 to accommodate some vertical movement of the drag blocks 105 to shear the shear screw 107.

A plate 112 located below the push rods 111 pushes the push rods 111 from the lower position shown in FIG. 1D to the upper position shown in FIG. 2D. Plate 112 is pushed up by movement of a lower locknut 113. Locknut 113 is non-rotatable relative to the body 41. A lower threaded section 115 is adapted to engage the locknut 113 when in the retaining position shown in FIG. 4D. The lower threaded section 115, which is located on the exterior of the body 41, is made up of right-hand threads. The threads of the lower threaded section 115 are saw-tooth in shape, but facing the opposite direction from the threads of the upper threaded section 97 (FIG. 1C). Each thread of the lower threaded section 115 has an inclined upper flank and a lower flank that is perpendicular to the axis of the body 41.

The lower locknut 113, similar to the upper locknut 99, is made up of segments connected by expansible springs. This allows the lower locknut 113 to ratchet over the lower threaded section 115 as the body 41 moves upward relative to the lower locknut 113. The distance from the top of the lower threaded section 115 to the bottom of the upper threaded section 97 is greater than the distance between the locknuts 99, 113. As a result, only one of the locknuts 99, 113 can engage its respective threaded section 97, 115 at one time.

A locknut housing 117 encloses the lower locknut 113 within a recess. Pins or keys (not shown) retain the lower locknut 113 against rotational movement relative to locknut housing 117. Locknut housing 117 is secured to the lower end of the drag block body 101 by threads. A shear screw 119 connects the locknut housing 117 to a bottom sleeve 121.

Bottom sleeve 121 has an upper shoulder 122 contained within an internal recess in the locknut housing 117. A shear screw 123 connects the bottom sleeve 121 to the lower end of the packoff body 41. Bottom sleeve 121 is cup-shaped, having an aperture in its bottom for receiving the lower mandrel section 65. The bottom sleeve 121 is perforated, having a plurality of holes 127 to admit well fluid into the axial passage 42.

The lower mandrel section 65 is threaded at its lower end. An adjustment nut 125 engages the threads of the lower mandrel section 65 at a selected point. The adjustment nut 125 causes upward force on the lower mandrel section 65 to be transmitted to the bottom sleeve 121.

Figure 4A:
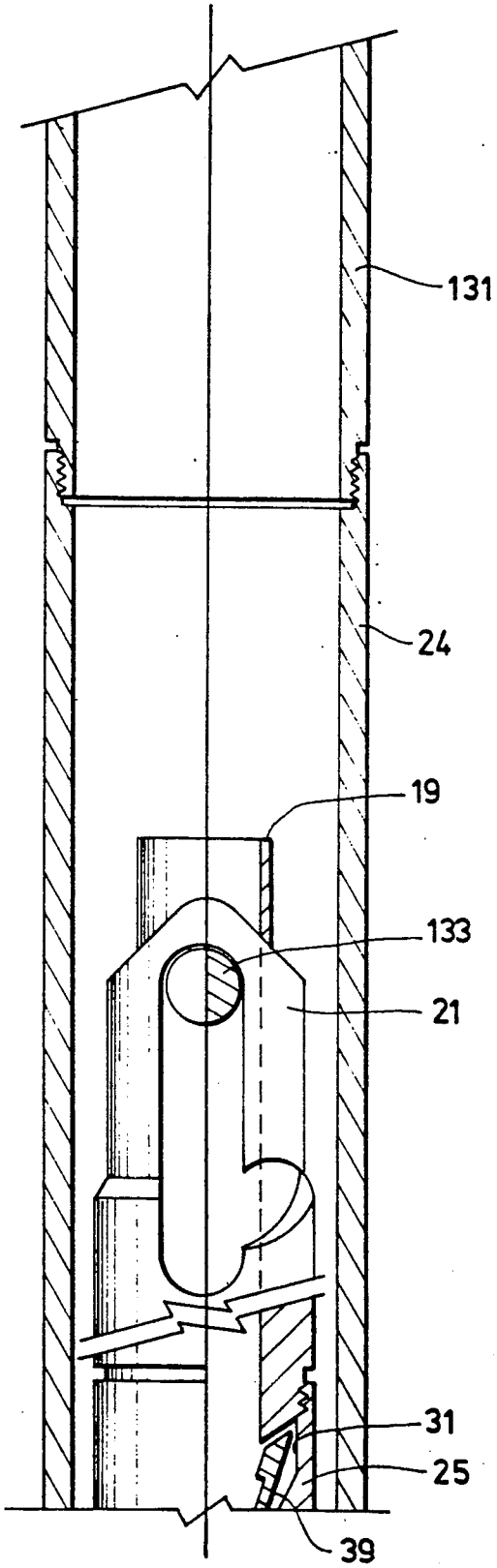
FIGS. 4A–4D are vertical sectional views of the packoff assembly of FIG. 1, showing the packoff assembly in a released position.
Figure 4B:
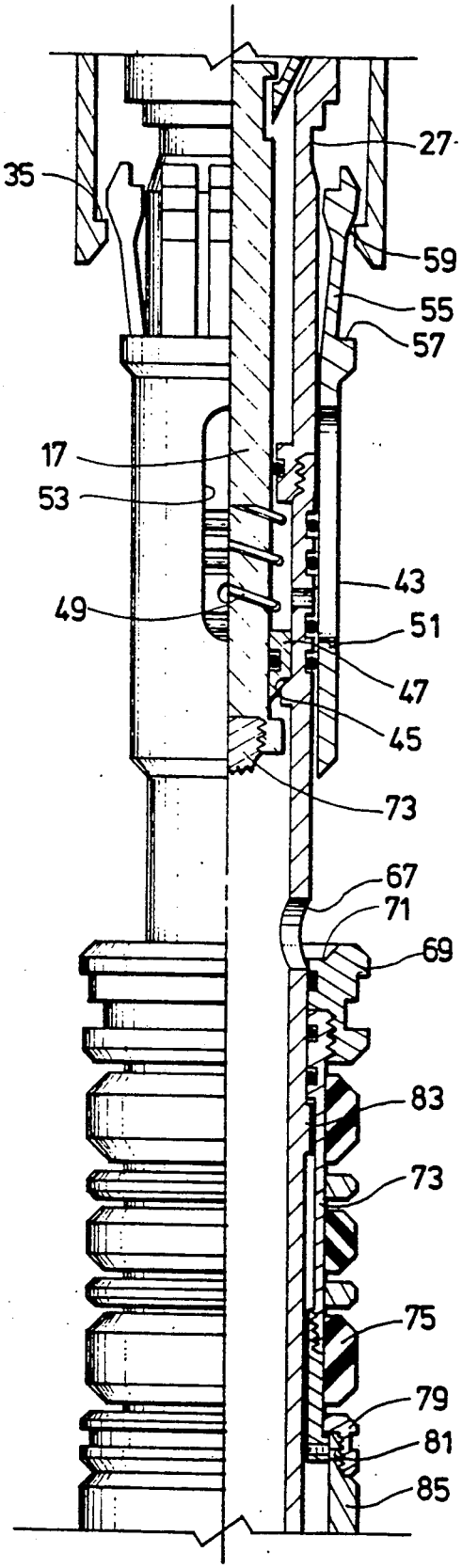

Referring to FIGS. 4A and 4B, the retrieving tool 24 is adapted to be secured to the lower end of a string of tubing 131. The retrieving tool 24 is a cylindrical member adapted to slide over the adapter 21. A pin 133 is rigidly secured to the retrieving tool 24 and extends inward. Pin 133 will engage the J-slot 23 when the retrieving tool 24 is lowered over the adapter 21. The retrieving tool 24 has internal shoulders 135 located on the lower end. Shoulders 135 are adapted to engage the shoulders 59 of the collet fingers 55 when the retrieving tool 24 is lifted.

In operation, the packoff assembly 40 will initially be set by the wireline setting tool 11. The upper mandrel 17 will be secured to the body 13. The setting sleeve 15 will engage the neck 19 of adapter 21. The operator will lower the packoff assembly 40 into the well with a wireline (not shown) supporting the entire assembly and wireline tool 11.

When at the proper depth, the operator will energize the wireline setting tool 11, normally by sending an electrical charge to an igniter (not shown) which ignites a charge. This causes the body 13 and setting sleeve 15 to move axially relative to each other. With reference to the setting sleeve 15, the upper mandrel section 17 will move upward, pulling along with it the intermediate mandrel section 33 and the lower mandrel section 65.

As shown in FIG. 1D, an upward force will be transmitted from the lower mandrel section 65 to a linkage means comprising the bottom sleeve 121. The packoff body 41 cannot move upward with the lower mandrel section 65 because the setting sleeve 15 (FIG. 1A) is exerting a downward force at the same time on the neck 19, which transmits through the adapter 21 and collet body 25 to the packoff body 41. Consequently, the shear screw 123 (FIG. 1D) will shear, allowing the bottom sleeve 121 to start moving upward relative to packoff body 41.

This upward movement of the bottom sleeve 121 is transmitted through a carriage comprising the locknut housing 117, drag block body 101 (FIG. 1C), slip bowls 91, 85 (FIG. 1C), gage ring 79 and seal sleeve 73 (FIG. 1B). The seal sleeve 73 will not move significantly upward because it will contact the shoulder 83 formed on the body 41, which is moving downward relative to the lower mandrel section 65.

Figure 2B:
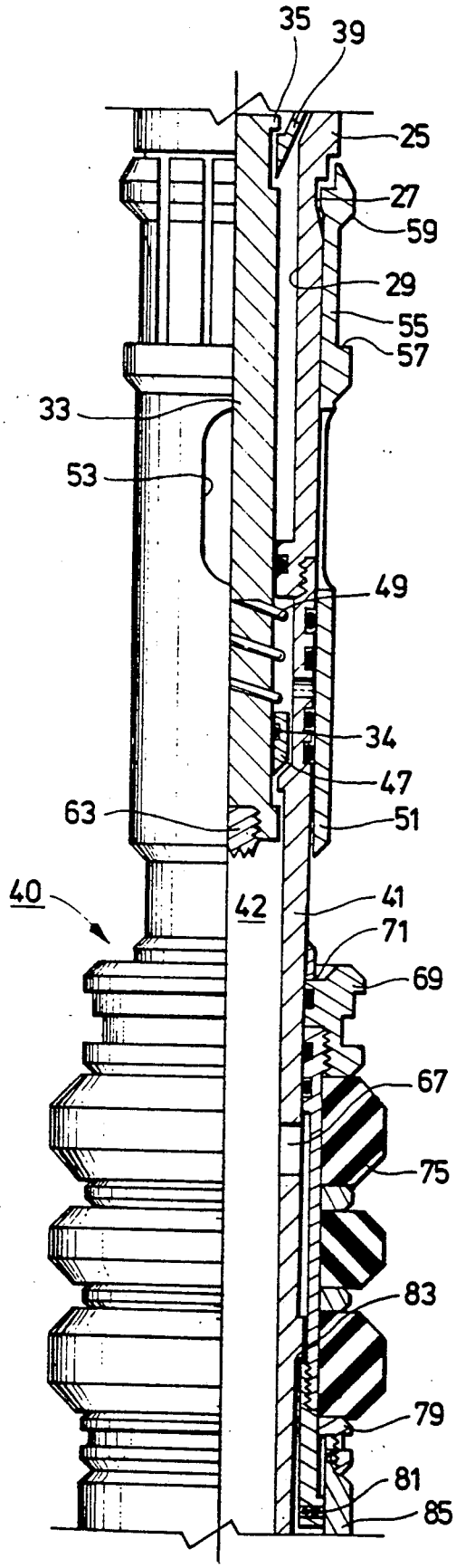
Figure 2C:
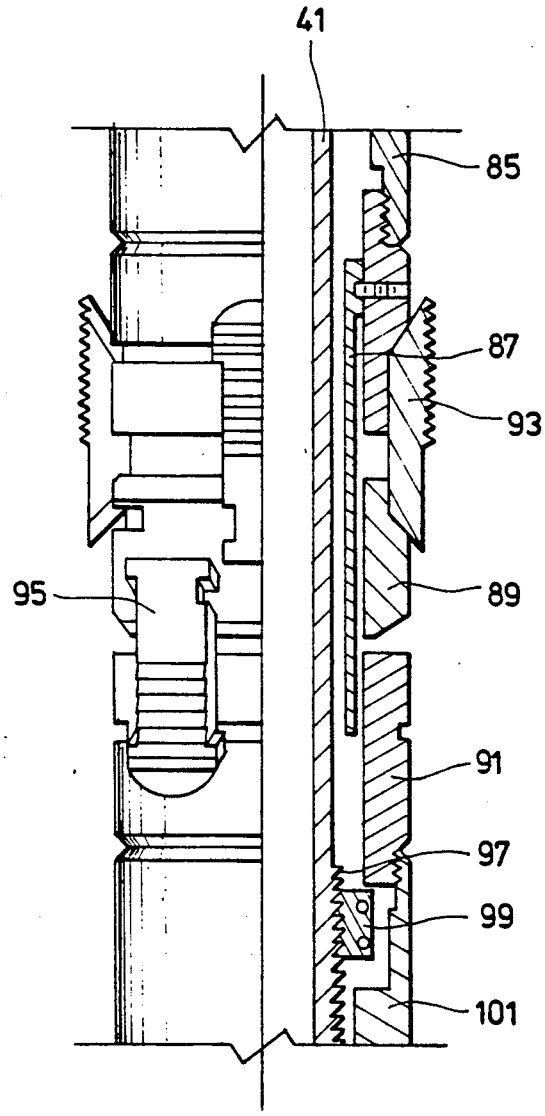
Figure 2D:
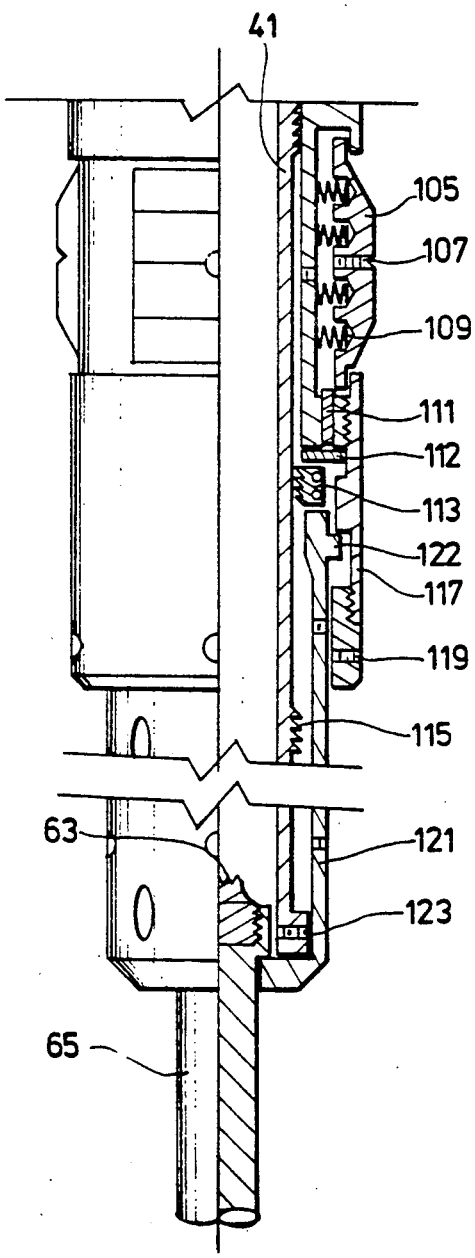

The shear pin 81 will shear, allowing the gage ring 79 to move toward the top seal ring 69, to deform the seals 75 to the set position shown in FIG. 2B. The lower slip bowl 91 will move upward relative to the upper slip bowl 85, which is stopped from movement due to contact of the gage ring 79 with the seals 75. This causes the slips 93, 95 to extend outward to engage the casing.

The upper locknut 99 will ratchet on the upper threaded section 97 as the threaded section 97 moves downward relative to upper locknut 99 to the position shown in FIG. 2C. The shear screw 119 shown in FIG. 1D will shear, enabling the bottom sleeve 121 to push the locknut 113 upward, which in turn presses the plate 112 and the plunger 111 upward. The push rods 111 push the drag blocks 105 upward, shearing the shear screw 107. This releases the drag blocks 105 to spring outward to the extended position.

Once this has occurred, the continued upward force on the upper mandrel section 17 will cause the shear stud 63 (FIG. 2B) to part. The lower mandrel section 65 then drops downward to the bottom of the bottom sleeve 121 as shown in FIG. 2D.

The upper mandrel section 17 continues to move upward relative to the collet body 25 (FIG. 2B). The fingers 39 will enter the recess 31 (FIG. 2A). This releases the upper mandrel section 17 from the intermediate mandrel section 33, as shown in FIG. 2A. The operator will then retrieve the wireline setting tool 11 by pulling upward on the cable. The upper mandrel section 17 will return with the wireline setting tool 11.

The adapter 21 and collet body 25 will remain downhole with the packoff assembly 40. The packoff assembly 40 will serve as a bridge plug. Fluid below the seals 75 (FIG. 2B) cannot pass upward past the seals 75. The fluid is free to enter the axial passage 42, however, is stopped from upward movement by the O-ring seal 34 sealing on the intermediate mandrel section 33. At this time, zones above the packoff assembly 40 can be tested and treated.

Figure 3:
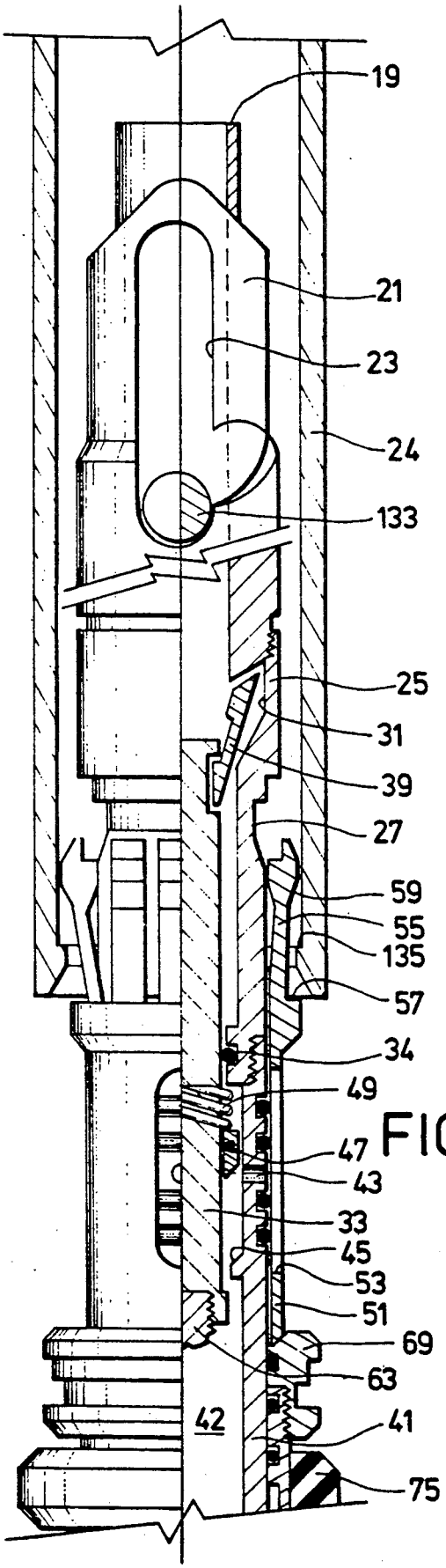
FIG. 3 is a vertical sectional view of the upper portion of the packoff assembly of FIG. 1, showing a tubing retrieving tool engaging the packoff assembly.

When it is desired to retrieve the packoff assembly 40, the retrieving tool 24 is lowered over the adapter 21, as shown in FIG. 3. The lower end of the retrieving tool 24 will contact the shoulders 57. The pin 133 will slide down the J-slot 23. This downward movement causes the valve sleeve 51 to slide downward to the open position shown in FIG. 3. The holes 53 will align with the upper port 43.

If the pressure in the well annulus above the seals 75 is greater than the pressure below, downward flow through the upper port 43 cannot occur because of the check valve member 47. If the pressure from below seals 75 is greater than above, well fluid can flow up the axial passage 42 and out the upper port 43. This enables the higher pressure from below to be equalized with that above before any releasing movement begins of the slips 93, 95 and seals 75. The check valve member 47 prevents any debris located in the vicinity of the upper port 43 from flowing down into the packoff assembly 40 before releasing movement occurs. Any debris located in this vicinity will be blown up the well if check valve member 47 opens because the pressure below will be greater.

Once the pressure, if any, from below seals 75 has bled off, the operator lifts the tubing string 131 (FIG. 4A) until the pin 133 locates at the top of the vertical portion of J-slot 23. This upward movement will also pull the valve sleeve 51 up, but not enough to close the upper port 43.

The operator then begins to rotate tubing 131 to the right. This results in the upper threaded section 97 unscrewing from the upper locknut 99 because of the left-hand threads. The body 41 will move upward relative to the slips 93, 95 and seals 75. The lower port 67 will move above the top seal ring 69. If the pressure above seals 75 is greater than below, well fluid in the annulus above the packoff assembly 40 can then flow downward through the lower port 67 and out the holes 127 in the bottom sleeve 121 (FIG. 4D). The debris that may have collected in the recess 71 on the top seal ring 69 (FIG. 4B) will be swept downward to clean the well above the packoff assembly 40.

Figure 4C:
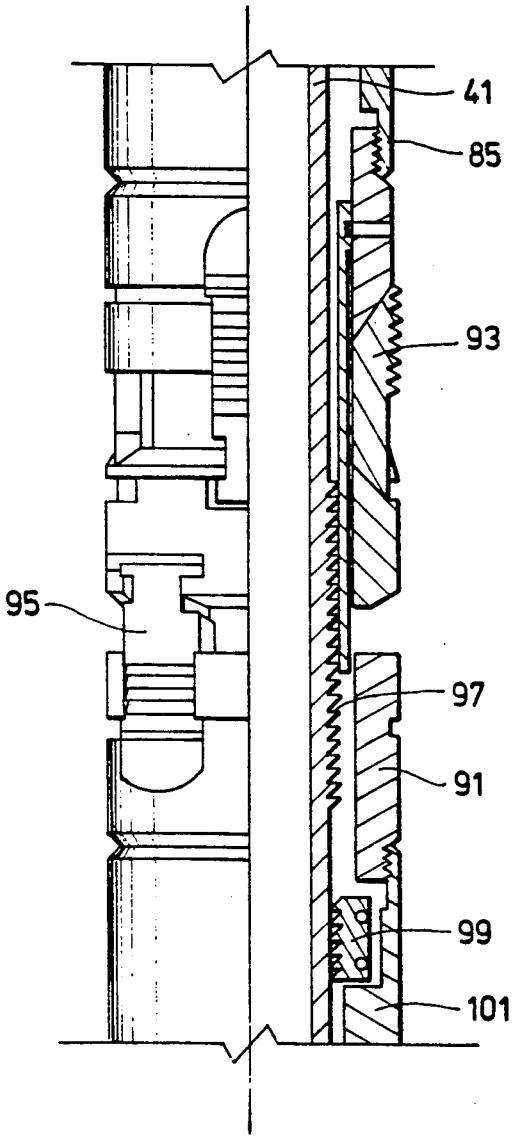
Figure 4D:
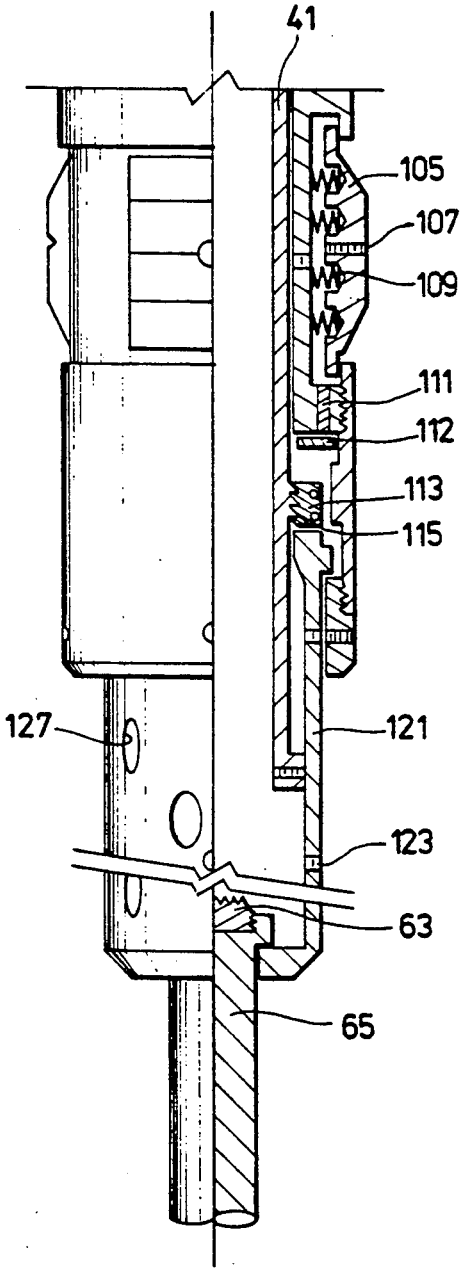

The disengagement of the upper locknut 99 from the upper threaded section 97 causes the lower slip bowl 91 to move downward from the upper slip bowl 85, as shown in FIG. 4C. This causes the slips 93, 95 to retract. As shown in FIG. 4B, the gage ring 79 moves downward from the top seal ring 69, causing the seals 75 to retract.

The operator then picks up the tubing 131. This movement causes the lower locknut 113 to ratchet onto the lower threaded section 115. Locknut 113 serves as retaining means to retain the body 41 in the released upper position shown in FIGS. 4B–4D. The operator, if he wished, could lower the packoff assembly 40 to reset it at a lower position in the well without accidentally setting the packoff assembly 40.

When the operator reaches the new location, to set the packoff assembly with the tubing 131, he will rotate the tubing 131 to the right to release the lower locknut 113 from the lower threaded section 115 (FIG. 4D). The drag blocks 105, which have continued to engage the casing since the shear screw 107 was sheared during wireline setting, will prevent rotation of the locknut housing 117 and lower locknut 113 while the body 41 rotates.

After the lower locknut 113 is unscrewed from the lower threaded section 115, the lower locknut 113 will be located above the lower threaded section 115. The operator slacks off on the tubing 131. The weight of the tubing 131 transmits through the pin 133 to the adapter 21, collet body 25, and packoff body 41. The drag blocks 105 (FIG. 4D) hold the drag block body 101 and lower slip bowl 91 (FIG. 1C) as the packoff body 41 moves downward.

The upper locknut 99 will begin to ratchet on the upper threaded section 97 as the body 41 moves downward. The shoulder 83 (FIG. 1B) pushes downward on the seal sleeve 73 to pull the top seal ring 69 downward relative to the gage ring 79. The slips 93, 95 will begin to move outward due to compressive force from the seals 75 pressing against the gage ring 79 as the top seal ring 69 moves downward. The drag blocks 105 will continue to resist downward movement of the lower slip bowl 91. The upper slip bowl 85, as it moves downward, causes the slips 93, 95 to move out and tightly grip the casing. Once the slips 93, 95 grip the casing, the drag blocks 105 will no longer be supporting the packoff assembly 40.

The weight of the tubing string 131 will tightly set the slips 93, 95 and seals 75. The upper locknut 99 will be located at the top of the upper threaded section 97, preventing the slips 93, 95 from releasing. The operator can then rotate the tubing 131 one-fourth turn to the left to uncouple the pin 133 (FIG. 4A) from the J-slot 23. The operator can then pick up the retrieving tool 24 and the tubing 131 to return to the surface.

As he picks up the retrieving tool 24, the valve sleeve 51 will move to its uppermost position with the fingers 55 engaging the groove 27 and fully blocking the upper port 43 as shown in FIG. 1B. The lower port 67 closes when the body 41 of the packoff assembly 40 is lowered relative to the top seal ring 69 during setting. The retrieving tool 24 can be lowered on tubing 131 again to release the packoff assembly 40 and reset it in the same manner.

Figure 5A:
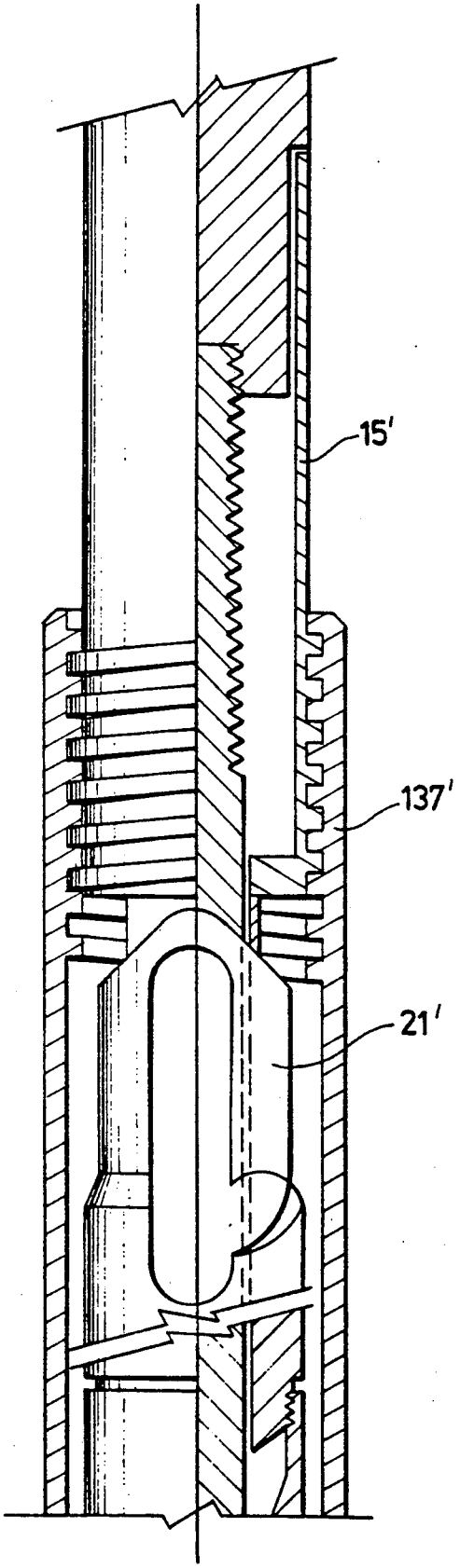
FIGS. 5A–5C are vertical sectional views of an alternate embodiment of equipment for adapting a conventional packoff assembly for use in accordance with this invention.
Figure 5B:
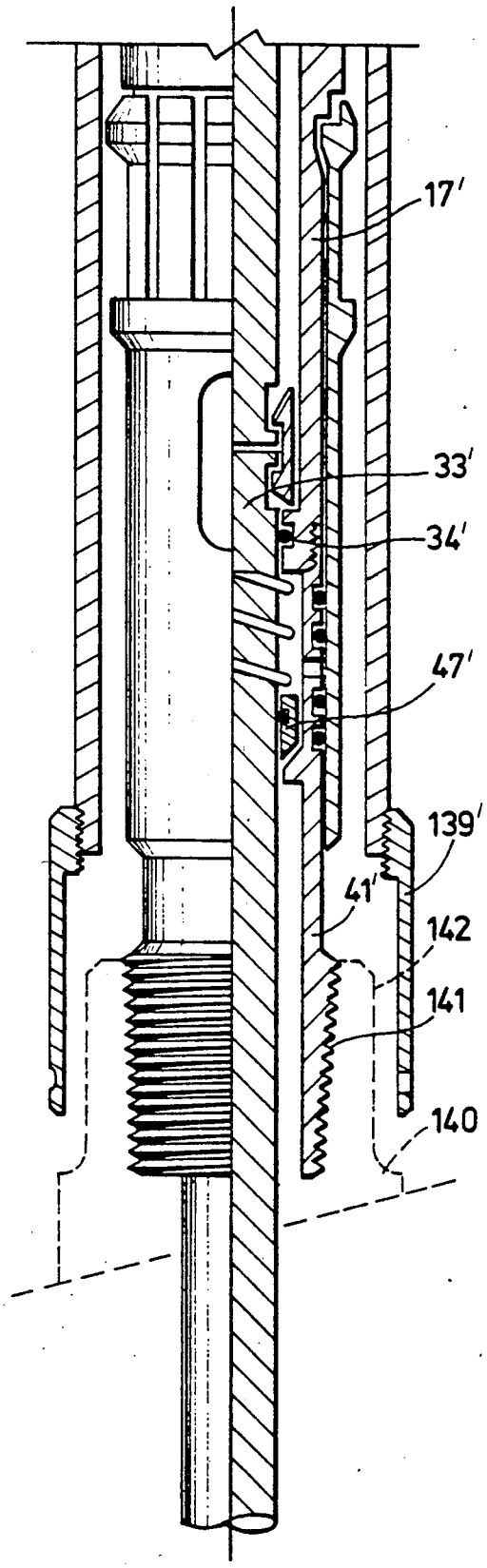
Figure 5C:
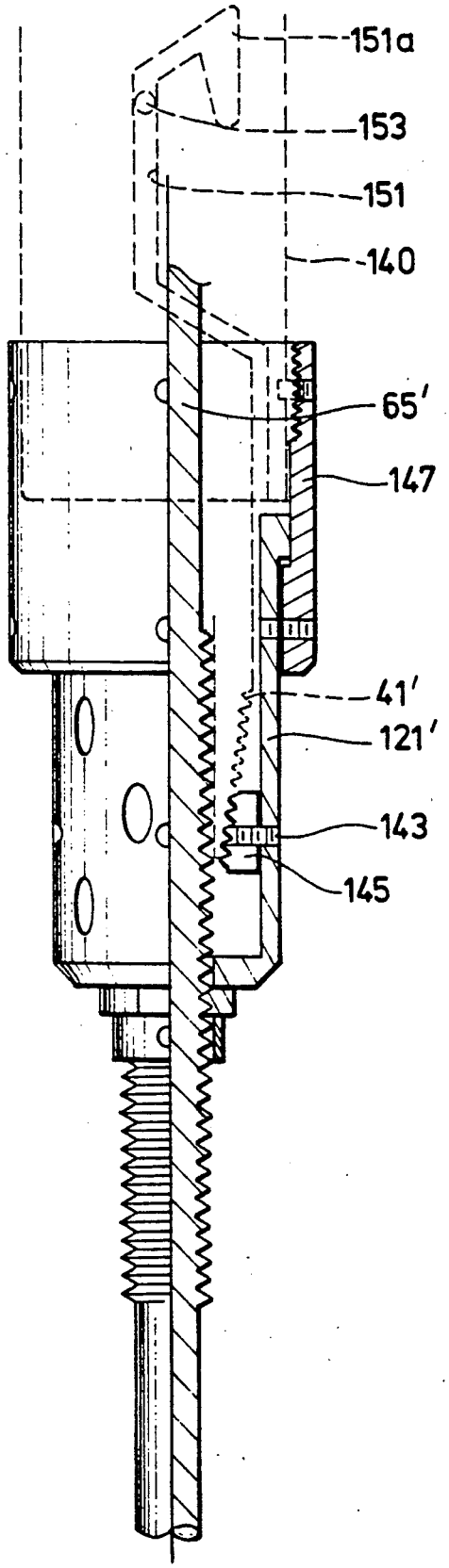

An alternate embodiment is shown in FIGS. 5A–5C. In this embodiment, a conventional packer (shown partially with dotted lines) can be converted to use as a bridge plug in accordance with this invention. The setting sleeve 15' is connected to a guide collar 137. The collar 137 has an adapter 139 on the end that will contact the slip and seal assembly 140 of the packer when set. The setting sleeve 15' applies downward force on body 41' by engagement with adapter 21'. The body 41' does not extend through the packer, rather it has a set of threads 141 which will engage the conventional tubular mandrel body 142 in the packer.

Referring to FIG. 5C, the lower mandrel section 65' extends through the mandrel body 142 and a bottom sleeve 121'. A retaining ring 145 will be connected to the bottom sleeve 121' by a shear pin 143. The retaining ring 145 is secured by threads to the lower end of the mandrel body 142.

The bottom sleeve 121' is rigidly secured to an adapter 147 that is connected to the lower end of the slips and seal assembly 140. The slips and seal assembly 140 has a guide slot 151 with a vertical portion and an offset release portion **151*a* on the upper end. A pin 153 secured to the mandrel body 142 locates in the guide slot 151**.

In the operation of the second embodiment, when set by the wireline tool, the lower mandrel section 65' pushes the bottom sleeve 121' upward, shearing the shear pin 143 (FIG. 5C). The body 41' (FIG. 5B) pushes down on the mandrel body 142. The upward movement of the bottom sleeve 121' relative to the mandrel body 142 causes the slips and seal section 140 to set conventionally. The guide slot 151 moves upward relative to the pin 153. Pin 153 remains in the vertical portion of guide slot 151 when the slips and seal assembly 140 is set. The intermediate mandrel section 33' seals the well fluid from flowing through the packer by means of the seal 34' (FIG. 5B). The upper mandrel section 17' releases from the intermediate mandrel section 33' and is retrieved in the same manner as previously described.

The packoff assembly is released conventionally by engaging adapter 21' and picking up on the tubing (not shown). The pin 153 (FIG. 5C) will enter the release portion **151*a* to hold the slip and seal assembly 140** in a released position until resetting.

When releasing, the valve member 47' (FIG. 5B) will open in the same manner as the first embodiment, if the pressure below the packer is greater than above. The packer has a conventional bypass passage which then opens as the releasing procedure begins. Rotating the tubing one-fourth turn causes the pin 153 to reenter the vertical portion of guide slot 151 (FIG. 5C) for resetting.

The invention has significant advantages. The upper bypass port and the check valve allow high pressure below the seal to be relieved before any releasing action on the packoff. This avoids the possibility of high pressure blowing the packoff assembly up the well, corkscrewing the tubing, before the pressure has been fully relieved. The check valve in the upper passage prevents debris from entering the packoff assembly before releasing, which could otherwise hamper the ability of the tool to release and reset. The lower bypass port allows debris located on the tool to be washed down after releasing movement has already begun. The three piece mandrel allows a tubular packer type element to be used as a bridge plug due to the sealing on the intermediate mandrel section. The upper and lower ratcheting locknuts allow the packoff assembly to be released and moved to a lower position in the well, then reset. The shearing mechanisms of the drag blocks are simple and effective.

While the invention has been shown in only two of its forms, it should be apparent to those skilled in the art that it is not so limited, but is susceptible to various changes without departing from the scope of the invention.

I claim:

1. A resettable apparatus for sealing against casing in a well, comprising in combination:

a packoff assembly having a slips and seal assembly for engaging the casing;

a wireline setting tool adapted to be releasably connected to the packoff assembly and lowered into the well with the packoff assembly on wireline for actuating the slips and seal assembly, the wireline setting tool being retrievable after setting the packoff assembly;

a retrieving tool adapted to be connected to a string of tubing, lowered into the well and into engagement with the packoff assembly for releasing the slips and seal assembly, the retrieving tool also adapted to pick up the packoff assembly and reset it at another location in the well;

check valve means mounted to the packoff assembly and operable prior to the slips and seal assembly being released, the check valve means having a bias means acting against any pressure from below the slips for allowing well fluid below the slips and seal assembly to flow upward above the slips and seal assembly to equalize pressure only if the pressure below the slips and seal assembly is greater than above by an amount sufficient to overcome the bias means, the check valve means having seat means for preventing downward flow of fluid through the check valve means past the slips and seal assembly; and bypass passage means in the packoff assembly operable after the check valve means has been operated, for allowing well fluid in the casing to flow downward past the slips and seal assembly.

2. A resettable apparatus for sealing against casing in a well, comprising in combination:

a packoff assembly having a slips and seal assembly for engaging the casing;

a wireline setting tool adapted to be releasably connected to the packoff assembly and lowered into the well with the packoff assembly on wireline for actuating the slips and seal assembly, the wireline setting tool being retrievable after setting the packoff assembly;

a retrieving tool adapted to be connected to a string of tubing, lowered into the well and into engagement with the packoff assembly for releasing the slips and seal assembly, the retrieving tool also adapted to pick up the packoff assembly and reset it at another location in the well;

check valve means mounted to the packoff assembly and operable prior to the slips and seal assembly being released, for allowing well fluid below the slips and seal assembly to flow upward above the slips and seal assembly to equalize pressure if the pressure below the slips and seal assembly is greater than above, and for preventing downward flow of fluid through the check valve means past the slips and seal assembly;

bypass passage means in the packoff assembly operable after the check valve means has been operated, for allowing well fluid in the casing to flow downward past the slips and seal assembly; and wherein the check valve means is located above the bypass passage means.

3. A resettable apparatus for sealing against casing in a well, comprising in combination:

a packoff assembly having a tubular body, and a slips and seal assembly mounted to the exterior of the body;

a wireline setting tool having a setting sleeve adapted to engage the upper end of the packoff assembly, and a mandrel adapted to extend through the body, the wireline setting tool adapted to be lowered into the well with the packoff assembly on wireline;

the mandrel being movable upward relative to the setting sleeve and body;

means for engaging the lower end of the mandrel with the slips and seal assembly to cause the slips and seal assembly to set when the mandrel moves upward relative to the body;

means connected to the mandrel to release the wireline setting tool from the packoff assembly once the slips and seal assembly has set, to retrieve the wireline setting tool to the surface;

a retrieving tool adapted to be mounted to the lower end of a string of tubing for retrieving and resetting the packoff assembly after the wireline setting tool has been retrieved to the surface;

an adapter on the upper end of the body for receiving the retrieving tool;

means in the packoff assembly for releasing the slips and seal assembly upon a selected manipulation of the tubing;

an upper port extending through the body above the slips and seal assembly;

upper closure means for closing the upper port, and when the retrieving tool engages the adapter, for opening the upper port;

check valve means located in the body for allowing upward flow of well fluid located below the packoff assembly through the body out the upper port when the upper closure means is open, and for preventing all downward flow of well fluid located above the packoff means through the upper port;

a lower port extending through the body below the upper port; and lower closure means for closing the lower port, and for opening the lower port after the upper closure means has opened the upper port, to allow downward flow of well fluid from above to below the packoff assembly, the lower closure means being opened by said selected manipulation of the tubing.

4. The apparatus according to claim 3 wherein the upper closure means comprises a valve sleeve mounted to the body for axial sliding movement, the valve sleeve being moved down to open the upper port when the retrieving tool engages the adapter.

5. The apparatus according to claim 3 wherein the upper closure means closes the upper port when the retrieving tool resets the packoff assembly.

6. The apparatus according to claim 3 wherein the upper closure means comprises a valve sleeve mounted to the body for axial sliding movement, the valve sleeve being moved down to open the upper port when the retrieving tool engages the adapter, the valve sleeve having a plurality of collet fingers adapted to be engaged by the retrieving tool to pull the valve sleeve back up to close the upper port when the retrieving tool is being pulled upward from the adapter after resetting the packoff assembly.

7. The apparatus according to claim 3 wherein the lower closure means comprises an annular closure member mounted above the slips and seal assembly.

8. The apparatus according to claim 3 wherein the check valve means comprises a valve seat located in the body, a valve member carried on the valve seat for blocking any upward flow of well fluid through the valve seat, and spring means for urging the valve member into engagement with the valve seat, and for allowing the valve member to move upward from the valve seat if sufficient fluid pressure from below the valve seat is exerted on the valve member.

9. An apparatus for setting a packoff assembly in a well, the packoff assembly being of a type having a body with an axial passage, and a slips and seal assembly mounted to the exterior of the body, the apparatus comprising in combination:

a wireline setting tool adapted to be connected to a wireline;

a setting sleeve mounted to the wireline setting tool and adapted to engage an upper end of the packoff assembly;

a mandrel having an upper mandrel section, an intermediate mandrel section, and a lower mandrel section, the upper mandrel section being connected to the wireline setting tool, the intermediate and lower mandrel sections adapted to extend into the axial passage of the packoff assembly;

the upper mandrel section being movable upward relative to the setting sleeve;

fastener means for releasably securing the upper mandrel section to the intermediate mandrel section;

frangible means for connecting the intermediate mandrel section with the lower mandrel section;

means for engaging the lower mandrel section with the slips and seal assembly to set the slips and seal assembly when the lower mandrel section moves upward relative to the body;

the frangible means having a shear member which parts for releasing the lower mandrel section from the intermediate mandrel section once the slips and seal assembly has set; and the fastener means releasing the upper mandrel section from the intermediate mandrel section after the slips and seal assembly has set and after the lower mandrel section has been released from the intermediate mandrel section, to allow the setting sleeve, upper mandrel section, and actuating means of the wireline setting tool to be retrieved to the surface.

10. The apparatus according to claim 9 wherein the axial passage of the packoff assembly is open at the bottom of the packoff assembly to admit well fluids, the apparatus further comprising:

seal means in the axial passage between the intermediate mandrel section and the body for preventing well fluids from flowing up the axial passage.

11. The apparatus according to claim 9 wherein the fastening means comprises:

a plurality of fingers mounted to one of the intermediate mandrel section and the upper mandrel section and extending into engagement with a shoulder on the other of the intermediate mandrel section and the upper mandrel section for holding the upper end of the intermediate mandrel section in abutment with the lower end of the upper mandrel section, the fingers being biased outward;

a reduced diameter section in the axial passage for maintaining the fingers in engagement with the shoulder; and an enlarged diameter section in the axial passage at the upper end of the reduced diameter section for allowing the fingers to spring outward and release engagement with the shoulder, the reduced diameter section having a length selected to assure that the shear member parts before the fingers reach the enlarged diameter section.

12. In a packoff assembly for a well of a type having a body with an axial passage, and a slips and seal assembly mounted to the exterior of the body, the improvement comprising in combination:

a wireline setting tool adapted to be connected to a wireline;

a setting sleeve mounted to the wireline setting tool and adapted to engage an upper end of the packoff assembly;

a mandrel having an upper mandrel section, an intermediate mandrel section, and a lower mandrel section, the upper mandrel section being connected to the wireline setting tool, the intermediate and lower mandrel sections extending into the axial passage of the packoff assembly;

the upper mandrel section being movable upward relative to the setting sleeve;

fastener means for releasably securing the upper mandrel section to the intermediate mandrel section;

frangible means for releasably connecting the intermediate mandrel section with the lower mandrel section;

means for engaging the lower mandrel section with the slips and seal assembly to cause the slips and seal assembly to set when the lower mandrel section moves upward relative to the body;

the frangible means having a shear member which parts for releasing the lower mandrel section from the intermediate mandrel section once the slips and seal assembly has set;

the fastener means releasing the upper mandrel section from the intermediate mandrel section after the slips and seal assembly has set and after the lower mandrel section has been released from the intermediate mandrel section, to allow the setting sleeve, upper mandrel section, and actuating means of the wireline setting tool to be retrieved from the well;

a retrieving tool adapted to be mounted to a string of tubing and lowered into the well;

adapter means mounted to the body of the packoff assembly for receiving the retrieving tool after retrieval of the wireline setting tool; and means in the packoff assembly for causing the slips and seal assembly to release when the body is manipulated in a selected manner by the tubing and for resetting the slips and seal assembly upon selected manipulation of the tubing.

13. The apparatus according to claim 12 further comprising:

bypass passage means operable for allowing fluid in the well to flow downward through the axial passage when releasing the slips and seal assembly.

14. The apparatus according to claim 13, wherein the bypass passage means comprises:

a port extending through the body;

an annular closure member mounted to the slips and seal assembly and positioned above the port when the slips and seal assembly is set for blocking flow through the port; and the body being axially movable relative to the slips and seal assembly when the retrieving tool engages the adapter to release the slips and seal assembly, positioning the port above the closure member as the slips seal assembly are released to allow flow through the axial passage.

15. In a packoff assembly for a well of a type having a body with an axial passage, and a slips and seal assembly mounted to the exterior of the body, the improvement comprising in combination:

a wireline setting tool adapted to be connected to a wireline;

a setting sleeve mounted to the wireline setting tool and adapted to engage an upper end of the packoff assembly;

a mandrel adapted to extend into the axial passage of the packoff assembly;

the mandrel being movable upward relative to the setting sleeve;

means for engaging the mandrel with the slips and seal assembly to cause the slips and seal assembly to set when the mandrel moves upward relative to the body;

frangible means for releasing the wireline setting tool from the packoff assembly once the slips and seal assembly has set, to allow the wireline setting tool to be retrieved from the well;

a retrieving tool adapted to be mounted to a string of tubing and lowered into the well;

an adapter mounted to the body of the packoff assembly for receiving the retrieving tool after retrieval of the wireline setting tool, and for causing the body to rotate with the tubing when the tubing is rotated;

means in the packoff assembly for causing the slips and seal assembly to release when the body is rotated by the tubing;

a port extending through the body of the packoff assembly;

an annular closure member mounted to the slips and seal assembly and positioned above the port when the slips and seal assembly is set for blocking flow through the port, the closure member having an annular recess on its upper end facing upward for collecting debris in the well; and the body being axially movable relative to the seal when the retrieving tool rotates the body to release the slips and seal assembly, positioning the port above the closure member as the slips and seal assembly is released to allow flow through the axial passage and to wash debris from the recess in the closure member.

16. A method for setting and releasing a packoff assembly in a well, the packoff assembly having a slips and seal assembly, the steps comprising:

connecting a wireline setting tool releasably to the packoff assembly and lowering the packoff assembly into the well on wireline;

setting the slips and seal assembly of the packoff assembly with the wireline setting tool and retrieving the wireline setting tool;

connecting a retrieving tool to a string of tubing, lowering the retrieving tool into the well and into engagement with the packoff assembly; then allowing well fluid below the seal to flow upward through an upper port a selected distance above the slips and seal assembly if the pressure below the slips and seal assembly is greater than above, and preventing downward flow of fluid past the slips and seal assembly; then releasing the slips and seal assembly with the tubing, and opening a lower port located above the slips and seal assembly and below the upper port to allow downward flow of fluid past the slips and seal assembly and through the lower port.

17. A method for setting a packoff assembly in a well, the packoff assembly being of a type having a body with an axial passage, and a slips and seal assembly mounted to the exterior of the body, the method comprising in combination:

connecting a wireline setting tool to a wireline, the wireline setting tool having a setting sleeve engaging an upper end of packoff assembly above the slips and seal assembly, the wireline setting tool having a mandrel with an upper mandrel section, an intermediate mandrel section, and a lower mandrel section;

connecting the upper mandrel section to the wireline setting tool;

releasably securing the upper mandrel section to the intermediate mandrel section;

releasably connecting the intermediate mandrel section with the lower mandrel section;

engaging the lower mandrel section with the slips and seal assembly;

lowering the wireline setting tool and packoff assembly on the wireline into the well to the desired depth;

moving the upper mandrel section upward relative to the setting sleeve, causing the lower mandrel section to set the slips and seal assembly;

releasing the lower mandrel section from the intermediate mandrel section once the slips and seal assembly has set; and releasing the upper mandrel section from the intermediate mandrel section after the slips and seal assembly has set and after the lower mandrel section has been released from the intermediate mandrel section; then retrieving the setting sleeve and upper mandrel section of the wireline setting tool from the well.

18. The method according to claim 17, further comprising the step of sealing the axial passage of the body by sealing the intermediate mandrel section in the body.

19. A resettable apparatus for sealing against casing in a well, comprising in combination:

a packoff assembly having a body with an axial passage;

a carriage mounted to the body and carrying a set of slips and a seal;

a wireline setting tool adapted to be connected to a wireline;

a setting sleeve mounted to the wireline setting tool and adapted to engage the upper end of the packoff assembly;

a mandrel extending from the wireline setting tool into the axial passage of the packoff assembly;

the mandrel being movable upward relative to the setting sleeve;

means for engaging the mandrel with the carriage to cause the slips to move upward relative to the body when the mandrel moves upward relative to the body;

a set of upper threads and a set of lower threads on the exterior of the body;

an upper nut and a lower nut nonrotatably carried by the carriage for engaging the upper and lower threads, respectively, the upper and lower nuts being spaced apart a distance less than the distance between the upper and lower threads, so that only one of the nuts can engage the threads at one time;

ratchet means in the upper nut for allowing the upper nut to ratchet over the upper threads as the carriage slides upward relative to the body to retain the slips and seal in set positions as the wireline tool moves the mandrel upward relative to the body;

frangible means for releasing the wireline setting tool from the packoff assembly once the slips and seal have set to allow the wireline setting tool to be retrieved from the well;

a retrieving tool adapted to be mounted to a string of tubing and lowered into the well;

an adapter mounted to the body of the packoff assembly for receiving the retrieving tool after retrieval of the wireline setting tool, and for causing the body to rotate with the tubing when the tubing is rotated and for axially moving the body when the tubing is axially moved for causing the slips and seal to release and reset;

the upper threads being left-hand, so that right hand rotation of the body relative to the carriage by rotation of the tubing moves the body upward relative to the upper nut and carriage to release the slips and seal from the set positions;

ratchet means in the lower nut for allowing the lower nut to ratchet over the lower threads as the body is lifted upward by the tubing after the upper nut has unscrewed from the upper threads due to said right hand rotation, and for retaining the body in an upper position until resetting of the packoff assembly is desired;

the lower threads being right-hand, so that right hand rotation of the body relative to the carriage by the tubing while the lower nut engages the lower threads moves the body downward relative to the lower nut and carriage, disengaging the lower nut from the lower threads; and drag block means mounted to the carriage for frictionally engaging the casing to enable said right hand rotation of the body by the tubing while the lower nut engages the lower threads, and for holding the carriage stationary relative to the casing for allowing the body to be lowered relative to the carriage by the tubing after disengagement of the lower nut from the lower threads to return the slips and seal to the set positions.

20. The apparatus according to claim 19 wherein the axial passage of the body is open at the bottom to well fluid, the apparatus further comprising:

seal means for sealing the mandrel in the axial passage to prevent upward flow of well fluid.

21. A resettable apparatus for sealing against casing in a well, comprising in combination:

a packoff assembly having a body with an axial passage;

a carriage mounted to the body and carrying a set of slips and a seal;

a wireline setting tool adapted to be connected to a wireline;

a setting sleeve mounted to the wireline setting tool and adapted to engage the upper end of the seal;

a mandrel extending into the axial passage of the packoff assembly;

the mandrel being movable upward relative to the setting sleeve;

linkage means for engaging the mandrel with the carriage to cause the slips to move upward relative to the body and the seal to expand when the mandrel moves upward relative to the body;

frangible means for releasing the wireline setting tool from the packoff assembly once the slips and seal have set to allow the wireline setting tool to be retrieved to the surface;

a retrieving tool adapted to be connected to a string of tubing;

an adapter mounted to the body of the packoff assembly for receiving the retrieving tool after retrieval of the wireline setting tool, and for causing the body to rotate with the tubing when the tubing is rotated and for axially moving the body when the tubing is axially moved;

means in the packoff assembly for releasing the slips and seal from the set positions upon right hand rotation of the tubing to allow the packoff assembly to be reset at a new location;

retaining means in the packoff assembly for retaining the packoff assembly in the released position after releasing by said right hand rotation and while moving to said new location;

means in the packoff assembly for releasing the retaining means by additional right hand rotation and for resetting the slips and seal assembly at said new location by lowering the tubing;

a set of drag blocks mounted to the carriage for frictionally engaging the casing to enable said right hand rotation of the body by the tubing, and for holding the carriage stationary relative to the casing for allowing the body to be lowered relative to the carriage by the tubing after the retaining means has been released to return the slips and seal to the set positions;

spring means for urging the drag blocks outward to an extended position;

retention means for compressing the spring means and for maintaining the drag blocks in a retracted position; and releasing means cooperating with the linkage means for releasing the retention means as the mandrel moves upward to allow the drag blocks to move to the extended position.

22. The apparatus according to claim 21 wherein the retention means comprises a shear pin connected between the drag blocks and the carriage.

23. The apparatus according to claim 21 wherein the retention means comprises a shear pin connected between the drag blocks and the carriage, and wherein the releasing means comprises:

a plunger mounted vertically and slidably in the carriage below the drag blocks for upward movement by upward movement of the linkage means, the plunger being positioned to push the drag blocks upward to shear the shear pin.

* * * * *